US006644541B2

(12) United States Patent
Stewart et al.

(10) Patent No.: US 6,644,541 B2
(45) Date of Patent: Nov. 11, 2003

(54) SUBSTANTIALLY PAPERBOARD CONTAINER WITH TEAR-STRIP OPENING AND RECLOSURE FEATURE

(75) Inventors: Noel G. Stewart, Conyers, GA (US); L. David Fielder, Oxford, GA (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 10/003,026

(22) Filed: Nov. 2, 2001

(65) Prior Publication Data

US 2002/0084317 A1 Jul. 4, 2002

Related U.S. Application Data

(60) Provisional application No. 60/245,470, filed on Nov. 3, 2000.

(51) Int. Cl.[7] ..... B65D 17/40; B65D 5/54

(52) U.S. Cl. ..... 229/123.2; 220/276; 229/201; 229/211; 229/235

(58) Field of Search ..... 229/5.6, 123.2, 229/123.3, 201, 211, 235; 220/269, 270, 276

(56) References Cited

U.S. PATENT DOCUMENTS

| | | | | |
|---|---|---|---|---|
| 1,315,394 A | | 9/1919 | Penn | |
| 1,511,915 A | | 10/1924 | Sherk | |
| 1,656,645 A | * | 1/1928 | Moore | 229/123.3 |
| 1,961,535 A | | 6/1934 | Taylor | |
| 1,961,556 A | | 6/1934 | Fallows | |
| 1,961,559 A | | 6/1934 | Herrmann | |
| 1,961,560 A | | 6/1934 | Hermann | |
| 1,963,994 A | | 6/1934 | Hermann | |
| 2,008,088 A | | 7/1935 | Taylor | |
| 2,009,539 A | | 7/1935 | Wootton | |
| 2,053,726 A | * | 9/1936 | Marshall | 229/211 |
| 2,115,494 A | | 4/1938 | Lurssen | |
| 2,276,577 A | | 3/1942 | Hahn | |
| 2,314,338 A | | 3/1943 | Graves et al. | 229/5.5 |
| 2,330,878 A | | 10/1943 | Foley | |
| 2,433,683 A | * | 12/1947 | Coyle | 229/123.2 |
| 2,471,017 A | | 5/1949 | Wilcox | 229/5.5 |
| 2,690,288 A | | 9/1954 | Allen et al. | |
| 2,858,057 A | | 10/1958 | Mullinix | 229/4.5 |
| 2,898,025 A | | 8/1959 | Walker | 229/4.5 |
| 2,903,173 A | | 9/1959 | Hopkins | 229/5.5 |
| 2,966,292 A | | 12/1960 | Saidel | |
| 2,970,736 A | * | 2/1961 | Baughan | 229/5.6 |
| 3,241,739 A | | 3/1966 | Ahlemeyer | |
| 3,300,118 A | | 1/1967 | Owens | |
| 3,402,876 A | | 9/1968 | Kuchenbecker | |
| 3,409,200 A | * | 11/1968 | Balocca et al. | 220/270 |
| 3,409,206 A | * | 11/1968 | Slouka et al. | 229/201 |
| 3,892,310 A | | 7/1975 | Welin-Berger | 206/210 |
| 3,967,773 A | | 7/1976 | Kaufmann | |
| 4,113,101 A | | 9/1978 | Pupp et al. | |
| 4,673,126 A | * | 6/1987 | Hambleton | 229/123.3 |
| 5,620,135 A | * | 4/1997 | Stahlecker et al. | 229/123.3 |
| 6,047,878 A | * | 4/2000 | Lowry | 220/276 |
| 6,129,268 A | * | 10/2000 | Stahlecker | 220/270 |

FOREIGN PATENT DOCUMENTS

| | | |
|---|---|---|
| CA | 562745 | 9/1958 |
| CA | 726543 | 1/1966 |
| CA | 931927 | 8/1973 |
| CH | 212865 | 3/1941 |
| DE | 597 791 | 5/1934 |
| DE | 27 06 190 | 8/1978 |
| DK | 39533 | 11/1928 |
| EP | 0 844 185 A1 | 5/1998 |
| GB | 920354 | 3/1963 |
| JP | 5-124674 | 5/1993 |

* cited by examiner

*Primary Examiner*—Gary E. Elkins
(74) *Attorney, Agent, or Firm*—Greenberg Traurig, P.C.

(57) ABSTRACT

A tubular paperboard container having a tear-strip opening and reclosure feature. A lid is insertably received in an open top end of a tubular body portion, with an upturned edge region of the lid being flush against an inner surface of the tubular body portion. Removal of the tear strip exposes a downwardly extending portion of the lid that is insertably receivable, in a plug-like manner, in the remaining, now-open top end of the tubular body portion.

6 Claims, 3 Drawing Sheets

SUBSTANTIALLY PAPERBOARD CONTAINER WITH TEAR-STRIP OPENING AND RECLOSURE FEATURE

This application claims the benefit of provisional application 60/245,470 filed Nov. 3, 2000.

BACKGROUND OF THE DISCLOSURE

1. Field of the Invention

The present invention is directed to paperboard containers of the type known as "paper cans", and to structures for facilitating opening of such containers.

2. The Prior Art

Paperboard containers generally of the sort called as "paper cans" are known. Several such paper can constructions are disclosed in the following references: Taylor, U.S. Pat. No. 1,961,535; Fallows, U.S. Pat. No. 1,961,556; Herrmann, U.S. Pat. No. 1,961,559; Herrmann, U.S. Pat. No. 1,961,560; Herrmann, U.S. Pat. No. 1,963,994; and Wootton, U.S. Pat. No. 2,009,539. Each of these references is directed to a container for a liquid beverage, a dessert or other food article.

The Taylor '535 reference discloses a truncated conical container, having a top formed by inserting a plug-like lid member into the narrow end of a rolled-up conical tubular body. A double score line runs around the top of the body, and describes two circuits of the body, to effect removal of the top. The cover thus removed is not replaceable.

The Fallows '556 reference discloses a container in which the lid does not completely separate, but does reclose by having a portion of the lid received in the open top like a plug.

The Herrmann '559 reference discloses a container having a multilayer tubular body, in which the score lines on the outer layer are more vertically spaced than the score lines on the inner layer. The lid of Herrmann '559 reference incorporates a "bottomless" plug-like reclosable lid.

The Herrmann '560 reference discloses a multilayer container formed from a spirally wound web, forming two layers. The scores forming the tear strip vary in their vertical spacing, so that the outer layer has wider spaced scores, while the inner layer has more closely spaced scores. The inner and outer layers are glued together, so that a single circuit of tearing motion can tear off, both layers.

The Herrmann '994 reference discloses a multilayer container, in which the tearstrip is configured to leave an exposed portion of the lid panel, to form a plug like structure that can be received in the open top end of the tubular body.

The Wootton '539 reference discloses a multilayer container, having a multilayer tearstrip, in which the scores of the outer layer are substantially more vertically spaced than the scores of the inner layer.

The foregoing references typically describe structures that are formed by winding a sheet substantially more than once around into a tube or truncated cone, and then driving a lid member into an end of the tube, and, typically, using mere crimping force to roll the top edge of the tube or cone over and around upturned edge regions of the lid member.

It would be desirable to provide a paper can construction that does not require a substantial overlapping of layers of a tubular body sheet, to form the body of the container.

It would further be desirable to provide a paper can construction that is provided with an easy-open feature, such as a tear strip.

It would further be desirable to provide a paper can construction that is openable, such as by a tear strip feature, that is readily and nearly resealably reclosable.

These and other desirable characteristics of the invention will become apparent, in light of the present specification (including claims) and drawings.

SUMMARY OF THE INVENTION

The present invention is directed to a substantially paperboard container construction of the type known as a "paper can".

One embodiment of the invention comprises a tubular container fabricated at least in part from paperboard. The tubular container comprises a tubular body portion having a sidewall, formed from at least one or more layers of paperboard material. A lid is inserted into a one end of the tubular body portion, with an upturned edge region of the lid being positioned against inside surface portions of the sidewall. A topmost edge region of the sidewall is rolled over inwardly over the upturned edge region of the lid, and adhered to inside surfaces of the upturned edge region of the lid.

The tubular body portion is formed by a sheet, that is rolled so that end edges of the sheet overlap slightly, sufficient to permit adhesive affixation of overlying portions of the end edge regions.

At least one pair of score lines is formed in the sidewall, which form a tear strip that has an end at the free end edge of the overlapping end edges of the sheet forming the tubular body portion.

The at least one pair of score lines are positioned so that the horizontal portion of the lid is vertically between the score lines. Upon removal of the tear strip, portions of the upturned edge region of the lid and the horizontal portion of the lid are exposed. This exposed structure forms a plug-like structure that is insertably receivable into the now open top of the remaining tubular body portion, thereby leaving a reclosable lid structure.

DETAILED DESCRIPTION OF THE INVENTION

Figure 1:
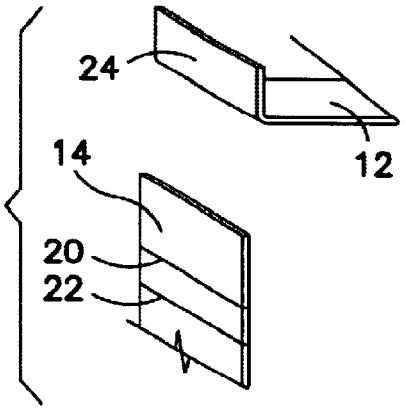
FIG. 1 is a fragmentary exploded perspective view of a top end of a paper can, according to an embodiment of the invention, prior to joining of the body to the lid.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated.

Figure 2:
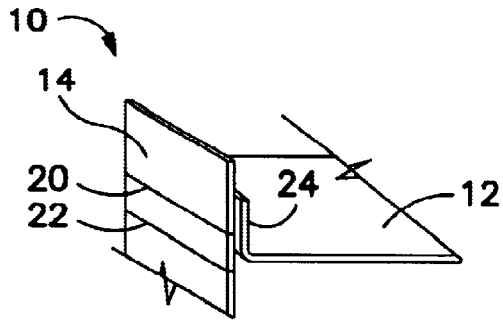
FIG. 2 is a fragmentary perspective view of a top end of a paper can, according to the embodiment of FIG. 1, prior to inward turning of the top edge of the body over the upturned edge region of the lid.
Figure 3:
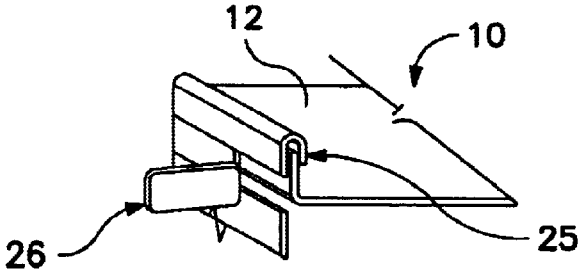
FIG. 3 is a fragmentary perspective view of a top end of a paper can, according to the embodiment of FIGS. 1 and 2, following completion of assembly, and after the initial pulling of the tear strip.

One embodiment of the invention is shown in FIGS. 1–3*a*. FIGS. 1–3*a* show fragmentary portions of the top region of a paper can according to one embodiment. While the embodiment of FIGS. 1–3 is shown as having at least one planar-sided portion, it is to be understood that the principles of the present invention may be readily applied to paper can constructions that are circular or oval in cross-section (as seen from above) by one of ordinary skill in the art, having the present disclosure before them, without departing from the scope of the invention.

The construction of FIGS. 1–3*a* construction involves a paper can, of one or more layers, having a lid without a membrane separating the lid from the interior of the container. See also FIG. 6. Container 10 is formed in part from lid 12 represented by the lid section shown in FIG. 1, and side wall 14, represented by the side wall section also shown in FIG. 1. Side wall 14 is preferably formed as a straight tube, that may be of circular, oval, generally rectangular or generally polygonal cross-section, through a section taken perpendicular to a vertical axis, relative to FIG. 1. The overlapping edges of the tubular body may be affixed in any suitable manner, provided that a free edge of the tear strip (to be described in further detail herein) is accessible for grasping, to facilitate opening of the tubular container.

Sidewall 14 is preferably provided with double, parallel, score lines 20, 22, which run along the circumference of the tubular body to be formed. Formation of the container may take place in two ways: 1) the tubular body may be formed first (e.g., around a mandrel) and the lid then inserted into the open top end of the tubular body; or alternatively, 2) the tubular body is formed by wrapping the side wall 14 around the upturned edge region 24 of the lid 12.

Substantially independent of which method is employed, attachment of the upturned edge region 24 of lid 12 to the sidewall 14 results in a configuration as shown in FIG. 2. The topmost edge of upturned edge region 24 is above score line 20, but the horizontal portion of lid 12 is below score line 20, but above score line 20. Preferably, lid 12 is not affixed to sidewall 14 at this stage. That is, there is no adhesive or other affixation between the inner surface of sidewall 14 (particularly between score lines 20, 22) and the outer surface of upturned edge region 24 of lid 12.

Instead, side wall 14 is adhered to upturned edge region 24 of lid 12, by a layer of heat activatable adhesive material disposed either on the upper inside surfaces of upturned edge region 24 of lid 12, or on the uppermost inside surfaces of side wall 14 (above the topmost portion of edge 24), or both. The topmost edge of side wall 14 is turned inwardly, crimped against the inside surface of upturned edge region 24, and heat is applied, creating a seal between the lid and the sidewall, but leaving the area around the score lines unencumbered. This region of adherence is shown in FIG. 3, as represented by numeral 25. This type of construction is contrary to prior art paper can constructions, in which the lid is affixed, with a primary seal, on an outer surface of the upturned edge region, to an inside surface of the sidewall, and with a secondary seal, on the inside surface of the upturned edge region of the lid.

FIG. 3 shows how, once tearing of tear strip 26, formed by pulling one end of the region defined by score lines 20, 22, has begun, a plug-like lid is formed. Upon complete removal of tear strip 26, the remaining lid structure incorporates a plug structure that is insertably receivable within the now-open top end of the remaining tubular body.

Figure 3A:
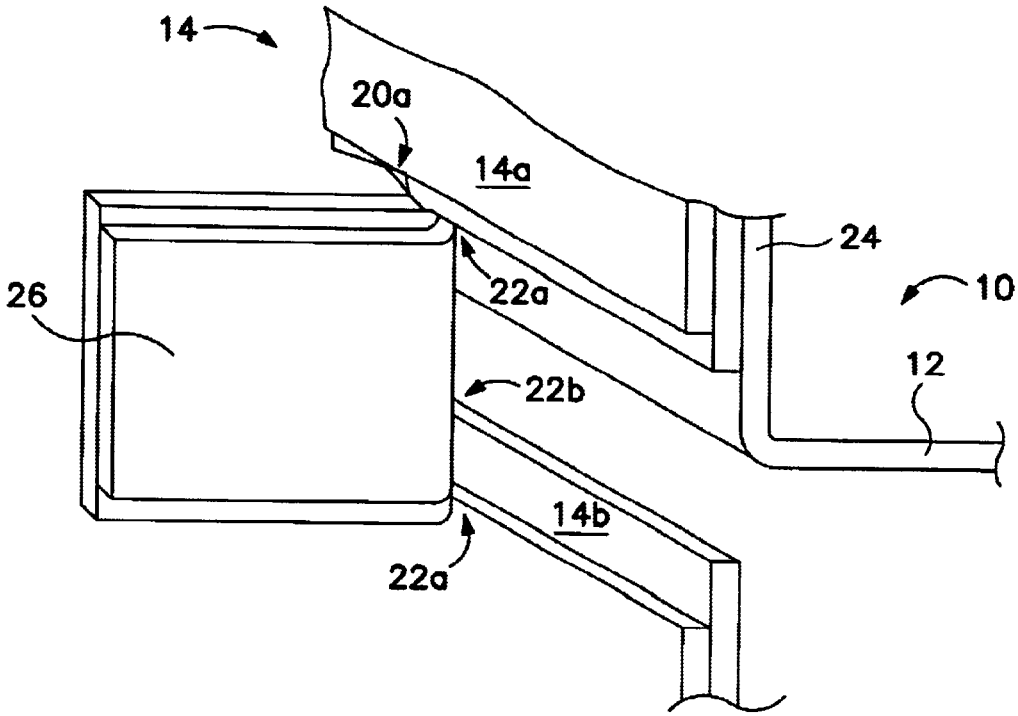
FIG. 3*a* is an enlarged perspective view of a portion of FIG. 3.

In a preferred version of the embodiment of FIGS. 1–3, shown in FIG. 3*a*, sidewall 14 is formed from two discrete layers 14*a* and 14*b* that are laminated together. Score lines 20, 22 are actually outer score lines 20*a*, 22*a*, and inner score lines 20*b*, 22*b*. A possible advantage of vertically offsetting the inner and outer score lines for the two layers is that while the vertical and circumferential strengths of the container from stacking forces or internal forces are not significantly compromised, the amount of shearing forces that must be applied to achieve tearing and removal of tear strip 26 are greatly reduced.

While embodiments of one or two layer sidewalls are described herein, a greater number of layers may be employed if desired. In such embodiments, preferably the free vertical edges of the sheet used to form sidewall 14 are only slightly overlapped, with a vertical line of adhesive being used to form and retain the tubular body shape.

Instead of using parallel score lines 20, 22 (20*a* and *b*, 22*a* and *b*, etc.) a strip of reinforce tape (not shown) may be applied to the inside surface of sidewall 14, to essentially create parallel score lines upon pulling.

Figure 6:
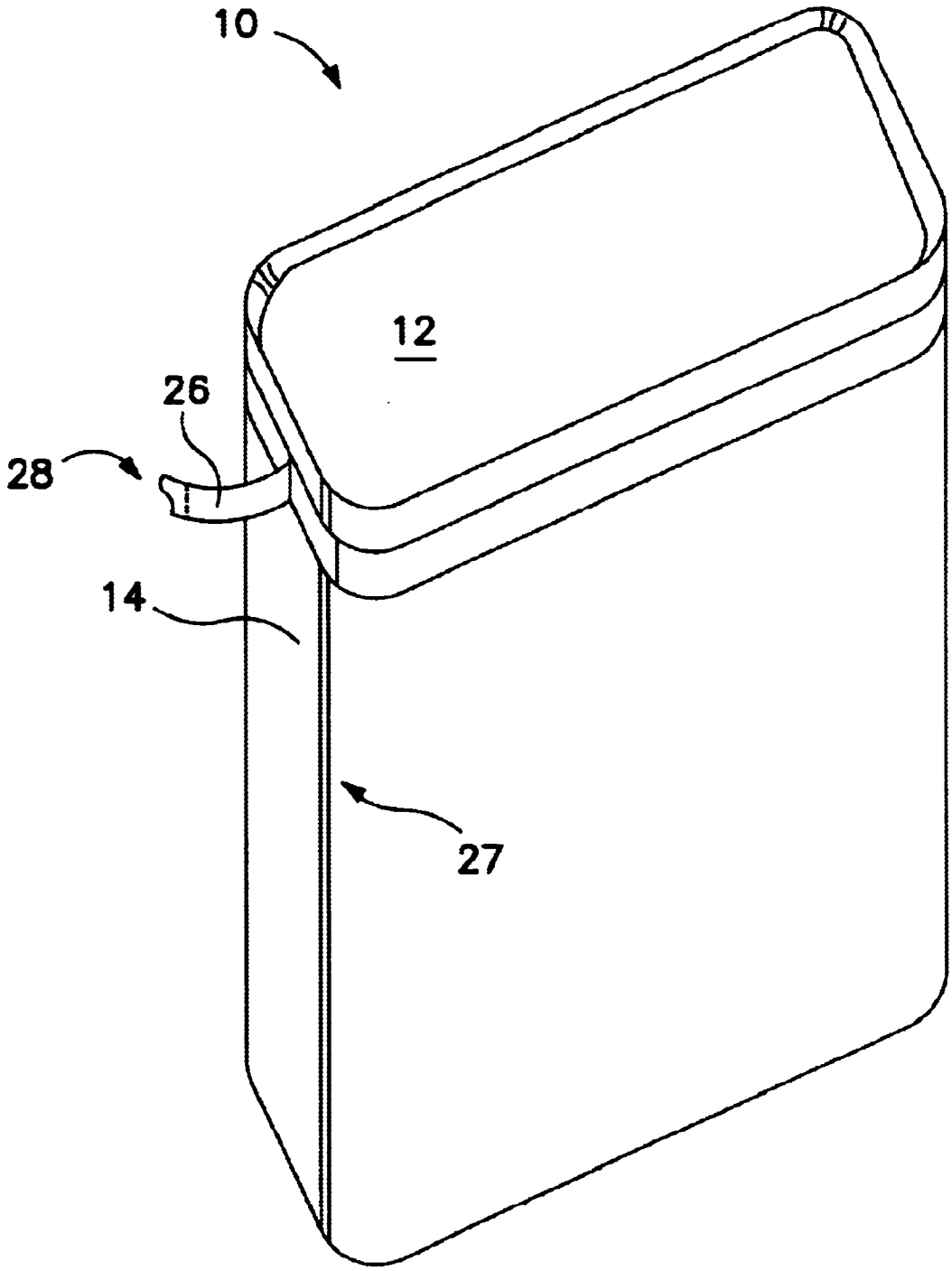
FIG. 6 is a perspective view of the overall paper can with tear strip, according to the embodiment of FIGS. 1–3.

FIG. 6 illustrates a complete paper can 10 according to the embodiment of FIGS. 1–3*a*. FIG. 6 shows in particular, the seam 27 formed by the sheet forming sidewall 14. Also, a peeled-away portion of tear strip 26 is shown. In the embodiment of FIGS. 1–3*a*, tear strip 26 ends flush with the edge of seam 27. Alternatively, a tab extension 28 may be provided, that further overlaps the underlying end of the sheet forming side wall 14, but is not adhered to it, so that the tab extension may be simply lifted up, without having to resort to a fingernail or implement to facilitate lifting and initial tearing of the tear strip.

Figure 4:
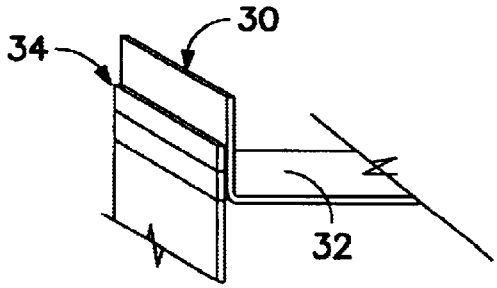
FIG. 4 is a fragmentary perspective view of a top end of a paper can, according to another embodiment of the invention, showing positioning of the upturned edge region of the lid, relative to the top edge of the body.
Figure 5:
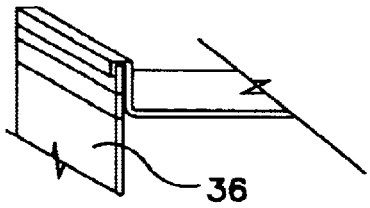
FIG. 5 is a fragmentary perspective view of a top end of a paper can, according to the embodiment of FIG. 4, following assembly of the lid and body.

In a second embodiment of the invention, shown in FIGS. 4 and 5, the peripheral upturned edge 30 of lid 32 is wrapped up, outwardly and over the top edge 34 of the tubular body sidewall 36. Parallel score lines or an embedded or buried tape, are provided in sidewall 36, in a manner similar to that employed in the embodiment of FIGS. 1–3*a*.

The foregoing description and drawings merely explain and illustrate the invention, and the invention is not limited except insofar as the appended claims are so limited, as those skilled in the art who have the disclosure before them will be able, to make modifications and variations therein without departing from the scope of the invention.

What is claimed is:

1. A tubular container fabricated at least in part from paperboard, comprising:

a tubular body portion having a sidewall, formed from at least one or more layers of paperboard material;

a lid, insertably received in one end of the tubular body portion, the lid having an upturned edge region of the lid positioned against inside surface portions of the sidewall, and a topmost edge region of the sidewall rolled over the upturned edge region of the lid, and adhered to vertically extending surfaces of the upturned edge region of the lid; and a circumferentially extending tearstrip formed in the sidewall, proximate the upturned edge region of the lid, whereupon removal of the tearstrip causes the tubular body portion to be shortened, with a portion of the sidewall remaining adhered to the lid, the lid becoming removable and reinsertable with respect to the tubular body portion.

2. The tubular container according to claim 1, wherein the tubular body portion is formed by a sheet, that is rolled so that end edges of the sheet overlap slightly, sufficient to permit adhesive affixation of overlying portions of the end edge regions.

3. A tubular container fabricated at least in part from paperboard, comprising:

a tubular body portion having a sidewall, formed from at least one or more layers of paperboard material;

a lid, insertably received in one end of the tubular body portion, the lid having an upturned edge region of the lid positioned against inside surface portions of the sidewall and a horizontal portion, and a topmost edge region of the sidewall rolled over inwardly over the upturned edge region of the lid, and adhered to inside surfaces of the upturned edge region of the lid, the tubular body portion is formed by a sheet, that being rolled so that end edges of the sheet overlap slightly, sufficient to permit adhesive affixation of overlying portions of the end edge regions, resulting in an outer free end edge, and an inner covered end edge; and at least one pair of score lines formed in the sidewall, forming a tear strip, the tear strip having an end at the outer free end edge of the overlapping end edges of the sheet forming the tubular body portion, the at least one pair of score lines being positioned so that the horizontal portion of the lid is vertically between the score lines, whereupon removal of the tear strip, portions of the upturned edge region of the lid and the horizontal portion of the lid are exposed, the exposed structure forming a plug-like structure that is insertably receivable into the now open top of the remaining tubular body portion, thereby leaving a reclosable lid structure.

4. The tubular container according to claim 3, further comprising:

the tubular container having a generally rectangular top plain cross-sectional configuration, with rounded corners.

5. A tubular container fabricated at least in part from paperboard, comprising:

a tubular body portion having a sidewall, formed from at least one or more layers of paperboard material;

a lid, insertably received in one end of the tubular body portion, the lid having an upturned edge region of the lid positioned against inside surface portions of the sidewall and a horizontal portion, and a topmost edge region of the sidewall, adhered to inside surfaces of the upturned edge region of the lid, a portion of the upturned edge region extending above, and being rolled over outwardly over the topmost edge region of the sidewall, and adhered to outside surfaces of the topmost edge region of the sidewall;

a circumferential portion of the sidewall being removable, whereupon removal of the circumferential portion, the exposed structure forming a plug-like structure that is insertably receivable into the now open top of the remaining tubular body portion, thereby leaving a reclosable lid structure.

6. A tubular container fabricated at least in part from paperboard, comprising:

a tubular body portion having a sidewall, formed from at least one or more layers of paperboard material;

a lid, insertably received in one end of the tubular body portion, the lid having an upturned edge region of the lid positioned against inside surface portions of the sidewall and a horizontal portion, and a topmost edge region of the sidewall, adhered to inside surfaces of the upturned edge region of the lid;

a circumferential portion of the sidewall being removable, whereupon removal of the circumferential portion, the exposed structure forming a plug-like structure that is insertably receivable into the now open top of the remaining tubular body portion, thereby leaving a reclosable lid structure.

* * * * *